United States Patent [19]

Parr

[11] 4,384,419

[45] May 24, 1983

[54] COLOR CHANGING DISPLAY

[76] Inventor: Willard J. Parr, P.O. Box 385, Yerington, Nev. 89447

[21] Appl. No.: 325,142

[22] Filed: Nov. 27, 1981

[51] Int. Cl.[3] ..... G09F 19/00

[52] U.S. Cl. ..... 40/406

[58] Field of Search ..... 40/406, 427, 486

[56] References Cited

U.S. PATENT DOCUMENTS

| | | | |
|---|---|---|---|
| 1,796,991 | 3/1931 | Harpham | 40/406 |
| 2,162,897 | 6/1939 | Rosenblatt | 40/406 |
| 2,235,636 | 3/1941 | Herte | 40/406 |
| 3,321,857 | 5/1967 | Schroer | 40/406 |
| 3,704,528 | 12/1972 | Lewis | 40/406 |

FOREIGN PATENT DOCUMENTS

| | | | |
|---|---|---|---|
| 534440 | 3/1922 | France | 40/406 |

*Primary Examiner*—Gene Mancene
*Assistant Examiner*—Wenceslao J. Contreras
*Attorney, Agent, or Firm*—Brown & Martin

[57] ABSTRACT

A color changing display in which various elements and portions of the display are formed as shallow transparent pockets on a supporting back panel. Each pocket is connected in a closed fluid circuit to an individual reservoir containing a suitably colored fluid. Actuating mechanism is used to raise and lower each reservoir individually so that fluid can flow into or drain out of selected pockets in any desired sequence or timed program. The result, viewed from the front through the transparent pockets, has the appearance of a display building up in a particular sequence or changing color in various patterns.

2 Claims, 3 Drawing Figures

COLOR CHANGING DISPLAY

BACKGROUND OF THE INVENTION

A display with moving or changing elements is much more effective in attracting attention than a stationary display. Flashing or varying lights, moving parts and other such motion producing effects have been used to animate display. Other types have used colored oils and similar fluid materials flowing through channels or tubes to attract attention. Such arrangements invariably use some time of pump, one for each color, and can become very complex for performing a simple task.

As examples, U.S. Pat. No. 3,413,744 shows a fluid type system in which flow of colored fluid to individual chambers is controlled by a fluid logic system driven by an external pressure source. U.S. Pat. No. 3,405,464 shows selective control of fluid flow to elements of a display character by a manometer type system, using an external pressure source for power. U.S. Pat. No. 2,645,048 is for a simpler type of display in which fluid is pumped through a continuous length of tubing formed into a me, the advancing fluid simulating the progressive writing of the name. These patents are representative of various methods of controlling fluid flow for display purposes, but all require considerable associated apparatus for their operation.

SUMMARY OF THE INVENTION

The apparatus disclosed herein includes a display in which the elements of the display are in the form of pockets formed in a transparent face sheet, which is secured to a supporting back panel. Each pocket has an inlet and an outlet, which are coupled in a closed fluid circuit through flexible hoses to an individual reservoir containing the required colored fluid.

Simple mechanical actuators are used to raise and lower the reservoirs selectively, so that fluid flows into and out of the individual pockets by gravity. Any suitable switching or sequencing means can be used to operate the mechanical actuators.

No pumps or external pressure sources are required and the entire mechanism can be mounted on the rear of the display if convenient. Since the colored fluids are sealed in closed individual systems, there is no possibility of contamination and no fluid loss.

The primary object of this invention, therefore, is to provide a new and improved color changing display.

Another object of this invention is to provide a color changing display in which the individual elements are filled or drained of colored fluid by gravity flow from a mechanically moved reservoir.

A further object of this invention is to provide a color changing display in which each element has a self-contained closed fluid system.

Other objects and advantages will be apparent in the following detailed description, taken in conjunction with the accompanying drawing, in which:

FIG. 2 illustrates schematically a control system for the display.

DESCRIPTION OF THE PREFERRED EMBODIMENT

The apparatus includes a display panel 10, which can be made from a single sheet of transparent or translucent material, such as plastic, or could be assembled from multiple elements. The display panel is secured to and supported by a back panel 12, shown mounted in a frame 14, although any convenient mounting may be used depending on the type of display and the location. The assembly is mounted vertically or near vertically for proper operation of the gravity flow system.

Figure 2:
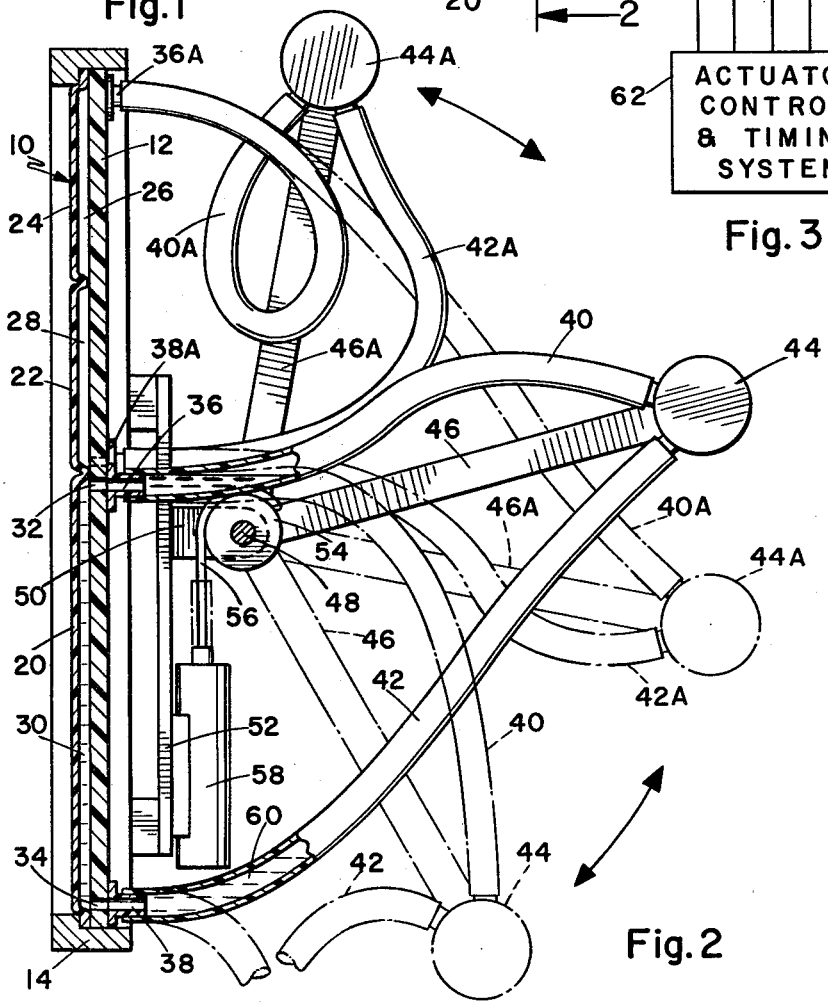
FIG. 2 is an enlarged sectional view taken on line 2—2 of FIG. 1.

Any type of display adaptable to the color changing technique may be used, such as a pictorial scene, an advertising sign with alphanumeric and geometrical characters, or the like. The example shown is a pictorial scene with a sailing boat having a hull 16 and sails 18 on an area of water 20, above which is a sky zone 22 with cloud 24. Each zone or element is embossed in the display panel 10 to form a shallow pocket against the front face of back panel 12. In FIG. 2 the pocket 26 of cloud 24, pocket 28 of sky 22 and pocket 30 of water 20 are illustrated. Each pocket in the display has an inlet 32 at the highest point and an outlet 34 at the lowest point. The inlet has an inlet hose fitting 36 and the outlet has an outlet hose fitting 38 mounted on or in the back panel 12.

Each pocket is coupled by an inlet hose 40 from the inlet fitting 36 and an outlet hose 42 from the outlet fitting 38 to a reservoir 44, in a closed fluid circuit. The reservoir contains fluid of an appropriate color for a particular element, the fluid being made to fill or drain from the pocket by raising or lowering the reservoir for gravity flow. Display panel 10 can be textured shaded, partially colored, or otherwise treated to enhance the display.

Various means may be used to raise and lower the reservoirs, the mechanism illustrated in FIG. 2 being an example. Reservoir 44 is mounted on an arm 46 which extends radially from a shaft 48. The shaft is mounted in brackets 50 on any suitable supporting structure 52, which may be secured to the rear of frame 14 or any adjacent surface, depending on the installation of the display. Fixed to the arm 46 is a pulley 54 and wrapped around the pulley is a cord or cable 56, which extends to a linear actuator 58 mounted on supporting structure 52.

As illustrated in the full line position, actuator 58 is retracted, pulling down on cable 56 and holding the reservoir 44 in the up position above the level of inlet 32. This would allow fluid 60 from the reservoir to flow through hoses 40 and 42 and fill pocket 30, so coloring the water area 20. When actuator 58 is extended, the cable 56 allows pulley 54 to rotate, lowering reservoir 44 to the broken line position below the level of outlet 34. The fluid would then drain back into reservoir 44, removing the color from the water area.

Each pocket and reservoir circuit would operate in a similar manner. In the upper portion of FIG. 2, the fluid system for the sky area 22 is shown in the raised and lowered position. All elements are numbers as described above, with the suffix A added for clarity. Reservoir 44A is raised above the level of inlet fitting 36A in the full line position and lowered below the level of outlet fitting 38A in the broken line position, to provide gravity flow of fluid into and out of pocket 28.

Figure 1:
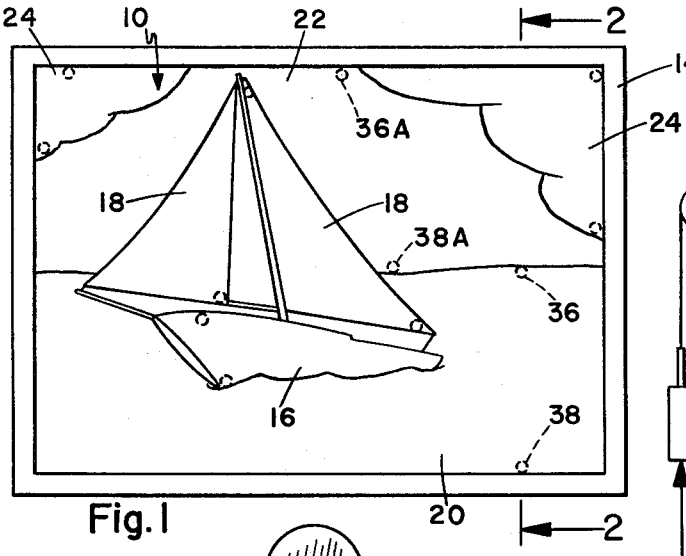
FIG. 1 is a front view of a typical display panel.
Figure 3:
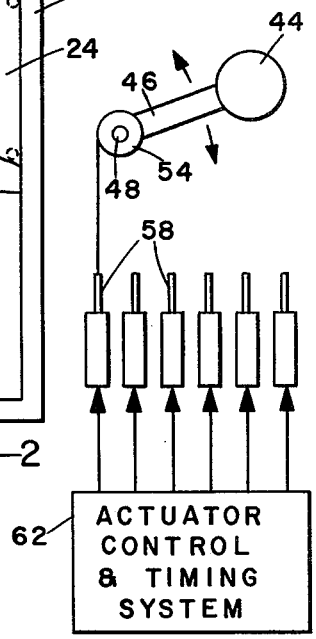

In the complete assembly, the shaft 48 would extend across the back of the display, and the arms and actuators would be spaced as necessary in a row. A multiple actuator system is shown in FIG. 3, with one actuator coupled to an arm 46 as an example. The actuators 58 are controlled by any suitable control and timing system 62, the principles of which are well known. The actuators can be operated in sequence, in groups, or in any other manner according to the nature and purpose of the display. It should be understood that the mechanism illustrated is only one example and that any comparable means may be used to raise and lower the reservoirs selectively.

The very simple gravity operated fluid control system is adaptable to a wide variety of displays. The closed fluid circuits avoid contamination and loss of fluids, reducing maintenance to a minimum.

Having described my invention, I now claim:

1. A color changing display, comprising:

an upright supporting back panel;

a display panel secured to said back panel, the display panel having elements of the display embossed therein and forming shallow individual pockets against the back panel, at least portions of the display being transparent;

each of said pockets having an inlet in the uppermost portion and an outlet in the lowermost portion thereof;

a source of colored fluid coupled between the inlet and outlet of each pocket, each source including a reservoir with flexible hoses connected therefrom to the inlet and outlet, and each reservoir, pocket and interconnecting hoses being an individual closed fluid system;

and actuating means connected to said reservoirs to move each reservoir selectively between a raised position above the inlet and a lowered position below the outlet of the associated pocket to cause fluid to flow into and out of the pocket.

2. A color changing display according to claim 1, and including a supporting structure having a plurality of arms pivotally mounted thereon, each arm having one of said reservoirs attached thereto;

said actuating means including actuators coupled individually to said arms to swing the reservoirs between the raised and lowered positions.

* * * * *